US009611692B1

(12) United States Patent
Rogers

(10) Patent No.: US 9,611,692 B1
(45) Date of Patent: Apr. 4, 2017

(54) ROPE LADDER RUNG AND METHOD OF MANUFACTURE

(71) Applicant: Donald Scott Rogers, Lafayette, LA (US)

(72) Inventor: Donald Scott Rogers, Lafayette, LA (US)

(73) Assignee: Apollomarine Specialties, Inc., New Orleans, LA (US)

( * ) Notice: Subject to any disclaimer, the term of this patent is extended or adjusted under 35 U.S.C. 154(b) by 51 days.

(21) Appl. No.: 13/750,567

(22) Filed: Jan. 25, 2013

(51) Int. Cl.
*E06C 7/08* (2006.01)
*E06C 1/56* (2006.01)

(52) U.S. Cl.
CPC . *E06C 7/08* (2013.01); *E06C 1/56* (2013.01)

(58) Field of Classification Search
CPC ... E06C 1/56; E06C 1/52; E06C 1/525; E06C 7/08
USPC ..... 182/189–190, 196–199, 228.1
See application file for complete search history.

(56) References Cited

U.S. PATENT DOCUMENTS 800,934 A * 10/1905 McArthur ..... E06C 1/56 182/198
913,117 A 2/1909 Feyma
1,349,125 A * 8/1920 Full ..... B63B 27/14 182/196
2,008,914 A 7/1935 Keiner
2,834,992 A 5/1958 Jupa
2,903,388 A 9/1959 Jonke et al.
2,966,229 A 12/1960 Frezieres
3,008,537 A * 11/1961 Roberts ..... E06C 1/56 182/196
3,077,241 A * 2/1963 Klages ..... E06C 1/56 182/196
3,077,636 A 2/1963 Peters
3,177,272 A 4/1965 Plymale
3,291,883 A 12/1966 Cornelius et al.
3,328,501 A 6/1967 Barnett
3,415,341 A * 12/1968 Hostetler ..... E06C 1/56 182/198
3,944,075 A 3/1976 Kuehn
3,945,784 A 3/1976 Collins
3,991,851 A * 11/1976 Gannon ..... 182/86
4,029,841 A 6/1977 Schmidt
4,100,668 A 7/1978 Ruff et al.
4,177,878 A * 12/1979 Salvarezza ..... E06C 1/56 182/199
4,188,236 A 2/1980 Robertson et al.
4,191,718 A 3/1980 Mallick et al.
4,230,501 A 10/1980 Howard et al.
(Continued)

*Primary Examiner* — Daniel Cahn
*Assistant Examiner* — Shiref Mekhaeil

(57) ABSTRACT

A rope ladder assembly having a colored ladder rung comprised of fiber reinforced thermoplastic is disclosed. The rung has an integrally molded non-skid top surface supported on longitudinally oriented support rib members and a plurality of transversely oriented crossing members. The rung is integrally molded of fiber reinforced plastic that is injected into a mold in a manner such that the flow path of fiber reinforced plastic is directed primarily longitudinally along the length of the rung during the molding process. A color additive comprising a base carrier and a non-organic class of pigment is added to the fiber reinforced thermoplastic prior to injection in the mold. The color additive is added at more than 2% of the thermoplastic mixture.

11 Claims, 5 Drawing Sheets

(56) References Cited

U.S. PATENT DOCUMENTS 4,241,809 A * 12/1980 Salvarezza ..... E06C 7/081 182/199
4,304,513 A 12/1981 Roch
4,319,724 A 3/1982 Bradbury
4,341,565 A 7/1982 Martenson
4,373,886 A 2/1983 Hehl
4,408,694 A 10/1983 Mueller
4,434,456 A 2/1984 Taylor
4,442,920 A * 4/1984 Gronbeck ..... E06C 7/081 182/199
4,471,854 A * 9/1984 Heilskov ..... E06C 1/56 182/196
4,554,996 A * 11/1985 Salvarezza ..... E06C 1/56 182/199
4,655,321 A * 4/1987 Salvarezza ..... E06C 1/56 182/196
4,683,981 A * 8/1987 Salvarezza ..... E06C 7/081 182/199
4,720,364 A 1/1988 Kauffman et al.
4,780,432 A 10/1988 Minford et al.
4,955,750 A * 9/1990 Goran ..... E06C 1/56 24/115 R
5,104,598 A 4/1992 Dolle
5,244,378 A 9/1993 Bross et al.
5,273,819 A 12/1993 Jex
5,533,314 A * 7/1996 Kunert ..... 52/788.1
5,582,270 A 12/1996 Fowler
5,882,575 A 3/1999 Atmur et al.
5,985,201 A 11/1999 Pierre et al.
6,082,462 A * 7/2000 Lyden ..... 168/24
6,106,752 A 8/2000 Chang et al.
6,214,263 B1 4/2001 McCullough
6,214,266 B1 4/2001 Millif et al.
6,344,160 B1 2/2002 Holtzberg
6,460,654 B2 10/2002 Dibelardino et al.
6,482,508 B1 11/2002 Persson et al.
6,558,603 B2 5/2003 Wobbe et al.
6,646,038 B1 11/2003 Ali
6,652,796 B1 * 11/2003 Moriwaki et al. ..... 264/328.18
6,776,600 B1 8/2004 Zahoransky et al.
6,827,747 B2 12/2004 Lisi et al.
6,843,954 B2 * 1/2005 Porter ..... 264/513
6,874,598 B1 * 4/2005 Baker ..... 182/165
6,902,037 B2 6/2005 Salvarezza
7,026,377 B1 4/2006 Grant
7,045,202 B2 5/2006 Tanaka et al.
7,364,788 B2 4/2008 Kishbaugh et al.
7,594,961 B2 9/2009 Booth et al.
8,476,360 B2 * 7/2013 Tse et al. ..... 524/528
2002/0037965 A1 * 3/2002 Kinoshita et al. ..... 525/127
2002/0052440 A1 * 5/2002 Tochioka ..... B29B 9/14 524/494
2003/0079942 A1 * 5/2003 Pettit ..... E04H 4/144 182/115
2003/0188923 A1 * 10/2003 Moss ..... E06C 1/32 182/23
2005/0043443 A1 * 2/2005 Van Mullekom et al. ... 523/216
2005/0064120 A1 * 3/2005 Volpini et al. ..... 428/35.7
2005/0108983 A1 5/2005 Simko et al.
2005/0260387 A1 11/2005 Lux
2006/0159923 A1 * 7/2006 Becker-Willinger et al. ..... 428/403
2006/0228401 A1 10/2006 Braithwaite et al.
2007/0164481 A1 * 7/2007 Polk ..... B29C 31/047 264/320
2007/0205053 A1 * 9/2007 Isham ..... B29C 43/003 182/207
2008/0008838 A1 * 1/2008 Arpac et al. ..... 427/386
2009/0197000 A1 * 8/2009 Limerkens et al. ..... 427/340
2011/0209946 A1 * 9/2011 Leng ..... 182/129
2012/0190785 A1 7/2012 Ban et al.
2012/0313281 A1 * 12/2012 Aravamudan ..... 264/73
2012/0315816 A1 * 12/2012 Fowler et al. ..... 442/327
2013/0266837 A1 * 10/2013 Lee et al. ..... 429/120

* cited by examiner

ROPE LADDER RUNG AND METHOD OF MANUFACTURE

FIELD OF INVENTION

The present invention generally relates to marine rope ladders and more particularly relates to an injected molded rope ladder step and its method of manufacture.

BACKGROUND OF INVENTION

Collapsible rope or chain ladders with ridged rungs or steps are commonly used in the marine environment. Such ladders, sometimes known as a Jacob's ladder, may be rolled up or collapsed when not in use and thrown over and hung from the side of a vessel to provide access. The ladder rungs are typically constructed of a variety of materials and can be wood, metal or sometimes even polymer. Polymer materials are frequently utilized on rope ladders intended for a marine environment because the use of polymer materials minimizes damage to the ladder rung associated with corrosion or rot from the wet or saltwater conditions.

The use of polymer materials to construct the rungs of a collapsible rope ladder presents a number of problems. Among these problems is the reduced strength and increased deformation associated with polymer ladder rungs and the increase in weight of the polymer rung that is typically required to provide adequate rung strength and minimize rung deformation. These disadvantages are typically addressed by utilizing a hybrid rung made from polymer and an external or internal metal reinforcing frame. However, these solutions increase the expense and effectiveness of marine rope ladders that utilize polymer treads.

Further, in the design and construction of a typical molded part, with a plastic that contains internal reinforcement fibers, the part to be molded and molding process typically configured in order to minimize plastic flow path length through the part and pressure drop of injection plastic across the part as the plastic is injected into the mold during manufacture. Such a strategy minimizes injection time, temperature differentials and pressure differences within the part being constructed. However, a disadvantage of this strategy is that it does not provide sufficiently for a desired orientation of the reinforcement fibers in the plastic during molding of the part.

Consequently, a need exist for improvements in polymer ladder rungs and rung construction techniques in order to provide collapsible rope ladders having polymer rungs for a marine environment that minimize the disadvantages currently associated with rope ladders having polymer ladder rungs.

SUMMARY OF INVENTION

The present invention provides a polymer ladder rung and method of construction that minimizes the weight of the ladder rung and at the same time provides for adequate rung strength while minimizing rung defection under loading. The ladder rung of the present invention is comprised of molded reinforced thermoplastic that eliminates the need for hybrid construction techniques utilizing metal reinforcing frames. The rung is configured to reduce rung deflection to no more than 0.5 inches while still providing for a reduction in rung weight by reducing the amount of thermoplastic material used in the rung.

The rung is designed to be molded in a single step with a blended thermoplastic having fiber reinforcement. Further, that fiber reinforcement is introduced into the mold in a manner so that the majority of fiber reinforcement is oriented to lie substantially in the direction of the major principle stress present in the rung under typical loading conditions. Additional care is taken to insure that the reinforcement fibers introduced into the thermoplastic at the rung surface in areas which are typically in tensile load are oriented in the direction of the major principle stress present under typical loading conditions.

DESCRIPTION OF THE EMBODIMENT OF THE INVENTION

Figure 1:
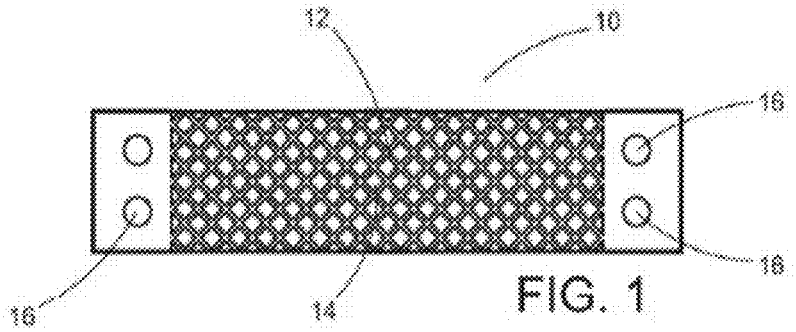
FIG. 1 is a top view of the ladder rung of applicant's invention.
Figure 2:
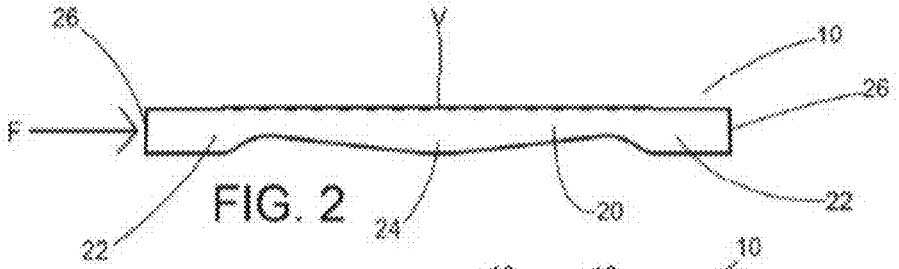
FIG. 2 is a side elevation view of the ladder rung shown in FIG. 1.

Referring now to the drawings and more particularly to FIG. 1 there is shown a top view of an embodiment of the ladder rung (10) of applicant's invention. The rung (10) is comprised of an integrally molded fiber reinforced thermoplastic base resin and has long sides (11), short sides (15), and a top surface (12) which may be configured with a non-skid surface (14) shown as a raised cross-hatched surface to provide an area of increased traction on the surface (12) of the ladder rung (10). The non-skid surface (14) may have a configuration other than the raised cross-hatched surface shown in FIG. 1. For instance, the non-skid surface (14) may be any anti-skid type surface such as a corrugated, grooved, ribbed, or lugged surface to provide the intended area of increase traction on the top surface (12) of the rung (10). As shown in FIGS. 1 and 2, each long side (11) of rung (10) extends longitudinally between and beyond rope holes (16) to each short side (15) to create a rectangular rung (10) with longitudinal ends (20).

Figure 3:
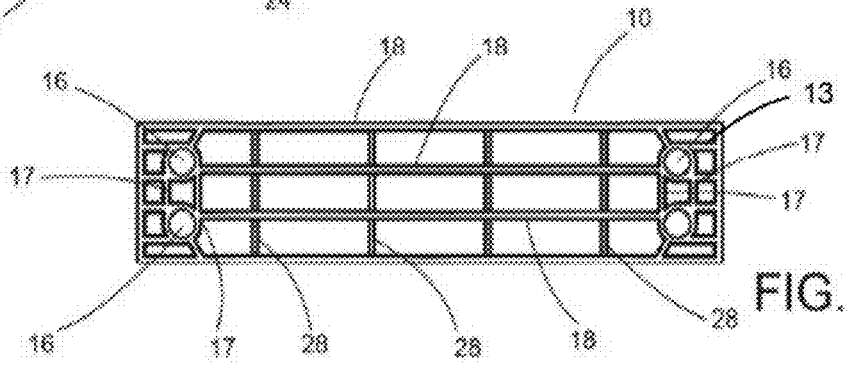
FIG. 3 is a bottom view of the ladder rung shown in FIG. 1.
Figure 4:
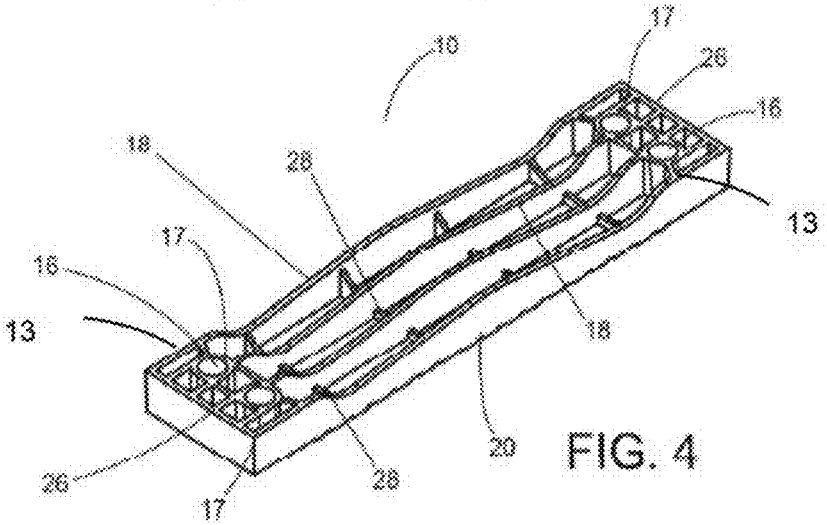
FIG. 4 is bottom isometric view of the ladder rung shown in FIG. 1.

Other than the elongated fibers carried in the thermoplastic base resin, no internal or external reinforcement reinforcing skeleton or structure, such as a metal frame around which plastic material is molded, is utilized to mold and construct the rung (10). Rather, as shown in FIGS. 2, 3, and 4, the top surface (12) of the ladder rung (10) is supported on a plurality of integrally molded plastic support ribs (18) extending longitudinally between each long side (11), which are transversely supported by integrally molded transversely positioned crossing members (28). The support ribs (18) and each long side (11) have a side profile (20) configured to vary in thickness with the anticipated principal stresses on ladder rung (10). As shown, the side profile (20) of the support ribs (18) has a profile section of increased thickness at the rope support region (22) of the rung (10) around the rope holes (16). The side profile (20) of the support ribs (18) and each long side (11) also has a bottom surface (13) with a center region (24) having a profile of increased thickness where bending moments on the rung (10) are likely to be the largest.

Figure 5:
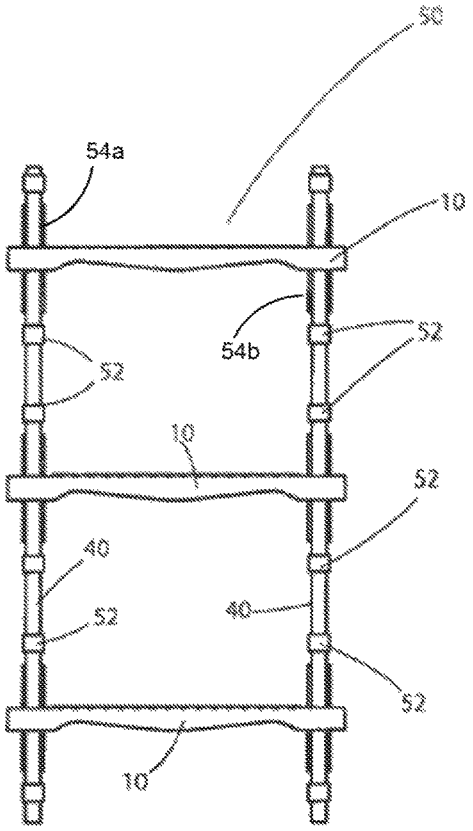
FIG. 5 is a front view of a rope ladder assembly with the ladder rung shown in FIG. 1.
Figure 6:
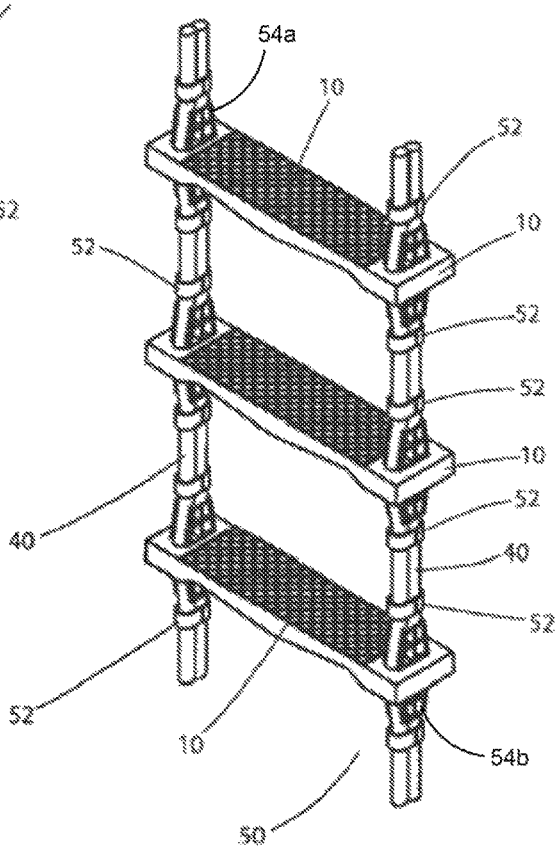
FIG. 6 is a perspective view of the rope ladder assembly with the ladder rung shown in FIG. 1.

Rope holes (16) supported by integrally molded reinforcing ribs (17) are provided at each end of the rung (10). The rope holes (16) allow for passage of ladder ropes (40) through the rung (10), as shown in FIGS. 5 and 6, so that a plurality of ladder rungs (10) are supported on the ropes (40) at each end of the rung (10) to create a rope ladder assembly (50). As shown in FIGS. 5 and 6, top bracers (54*a*) at the top surface (12) of rung (10) and bottom bracers (54*b*) at the bottom surface (13) of ribs (18) extend between the ropes (40). In such a construction clamps (52) are utilized to hold each pair of ropes (40).

In the design and construction of a typical molded part, the part and molding process is designed to minimize flow path length through the part and the injection pressure drop as the injected plastic flows across the part as the plastic is injected into the mold during manufacture. Such a strategy minimizes injection time, temperature differentials and pressure differences within the part being constructed. However, this strategy is not beneficial to the construction of the rung (10).

Figure 7:
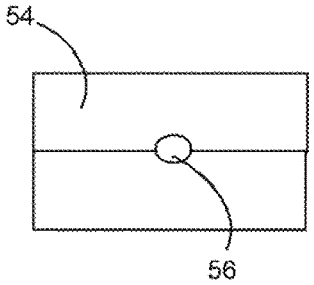
FIG. 7 is a schematic end view of a mold for the ladder rung shown in FIG. 1.
Figure 8:
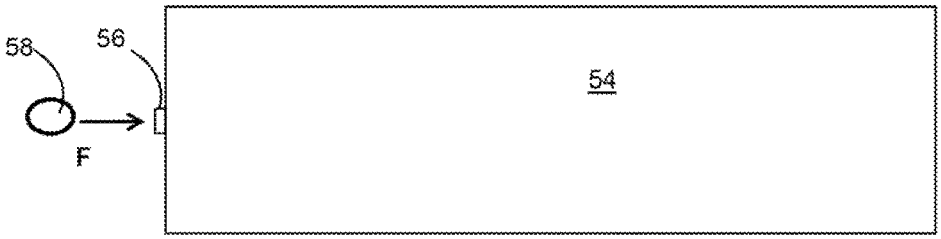
FIG. 8 is a schematic top view of the mold for the ladder rung shown in FIG. 7.

In constructing the rung (10), the thermoplastic material, along with the elongated reinforcing fibers carried in the plastic material, is injected into a mold (54) at injection point (56) during the molding process in a manner, as shown in FIGS. 7 and 8, to allow the thermoplastic material to flow in a direction that is perpendicular to the vector (V) of the primary load anticipated on the rung (10) as shown in FIG. 2 when it is in use, i.e. normal to its top surface (12), and parallel to the direction of the major principle stress. Consequently, during the molding process of the rung (10), the flow of thermoplastic is introduced into mold (54) at a sprue or injection point (56) which is at a longitudinal end (26) of the rung (10) rather than at the side or center of the rung (10) to produce a primary thermoplastic flow path (F) longitudinally along the length rather than the width of the rung (10) as shown in FIG. 2.

It is thought that the rung (10) will be constructed of long fiber reinforced thermoplastic (frp) resin material (58).

Figure 9:
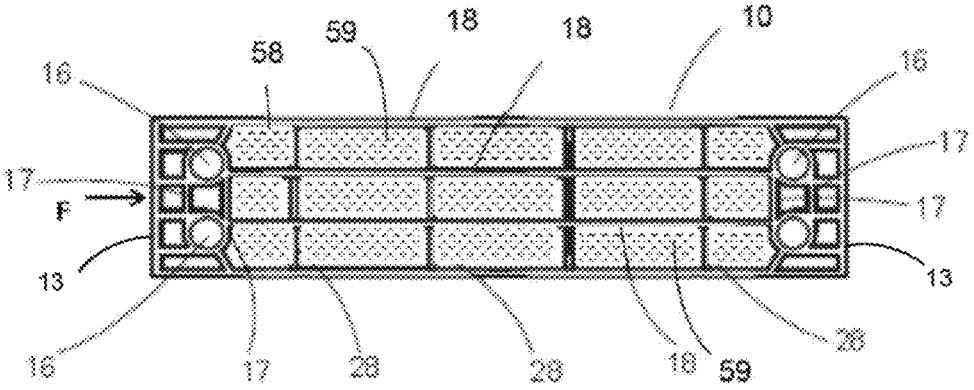
FIG. 9 is a schematic bottom view of the ladder rung shown in FIG. 1 showing the orientation of the reinforcement fibers during molding.

The selection of a longitudinal flow path (F) for the thermoplastic material during the molding process is of particular advantage when using a long glass fiber reinforcing material (59) in the thermoplastic as it allows for more of the reinforcement fibers to be placed in a longitudinal orientation during molding as shown in FIG. 9. Further, the few structural crossing members (28), which provide lateral support for the ribs (18), are constructed to have a shortened or minimized height with respect to the height of the side profile (20) of the rib (18) so that the height of the crossing member (28) does not extend to the height of the side profile (20) of the rib (18). The shortened or minimized height of the crossing members (28) helps to maintain the longitudinal flow of thermoplastic material (58) so as minimize the disruption of the longitudinal orientation of the reinforcement fibers as the thermoplastic material flows to the extremities of ribs (18).

Figure 10:
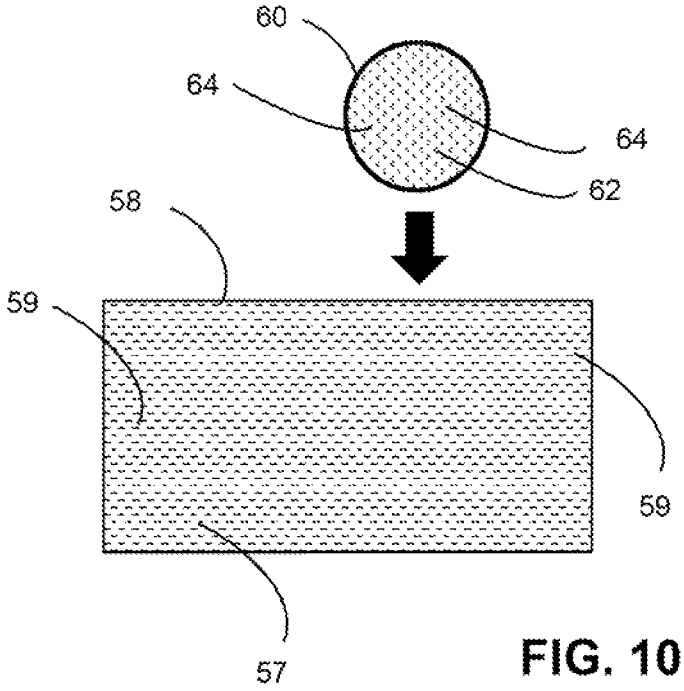
FIG. 10 is a schematic diagram of the components of the reinforced thermoplastic material utilized for molding the ladder rung shown in FIG. 1.

As shown in FIG. 10, a schematic diagram of the components of the reinforced thermoplastic material and color additives utilized for molding a ladder rung (10), a suitable thermoplastic material (58) will be a mixture of polyurethane (57) with long glass fibers (59). A color additive (60) comprising a base carrier (62) and a non-organic class of pigment (64) will be added to and blended with the thermoplastic resin material (58) for producing a rung (10) of a desired color, such as an orange color. The color additive (60) utilized is formulated with a base carrier (62) specifically selected for the thermoplastic rung material and not a generic carrier. The base carrier (62) will be the same type of material as the base resin (58). In some cases the base resin (58) (without fiber (59)) may be used.

Different non-organic pigments (64) will be utilized to produce the desired color. The advantage of a color additive (60) having a non-organic class of pigment is that this class of pigment will serve to preserve base resin strength of the pigment at higher processing temperatures utilized for the thermoplastic molding process. It is anticipated that the color additive (60) utilized will be added at more than 2% of the thermoplastic mixture which is not typical for color additives.

It is also thought that the ladder rung (10) and its method of construction as presented herein and the attendant advantages will be understood from the foregoing description and it will be apparent that various changes may be made in the form, construction and arrangement of the parts thereof without departing from the spirit and scope of the invention or sacrificing all of its material advantages, the form described herein being merely a preferred or exemplary embodiment of the invention.

I claim:

1. A rope and ladder rung assembly comprising:

(a) a plurality of ladder rungs, each said ladder rung having a rectangular longitudinally extending top rung surface, longitudinally extending sides, first and second ends, a plurality of support ribs extending longitudinally along a length of said top rung surface between said first and second ends, said support ribs having a side profile extending below said top rung surface, said support ribs creating a longitudinally extending bottom rung surface, at least one crossing member providing lateral support to said plurality of support ribs, said crossing member having a side profile height less than a side profile height of said plurality of support ribs, a first and a second rope passage at said first end of each said ladder rung, and a third and a fourth rope passage at said second end of each said ladder rung;

(b) a first rope passing through said first rope passage at said first end of each said ladder rung and a second rope passing through said second rope passage at said first end of each said ladder rung;

(c) a third rope passing through said third rope passage at said second end of each said ladder rung and a fourth rope passing through said fourth rope passage at said second end of each said ladder rung;

(d) a first top bracer positioned at said top rung surface of each said ladder rung around said first rope and said second rope at said first end of each said ladder rung, and a second top bracer positioned at said top rung surface of each said ladder rung around said third rope and said fourth rope at said second end of each said ladder rung;

(e) a first bottom bracer positioned at said bottom rung surface of each said ladder rung around said first rope and said second rope at said first end of each said ladder rung, and a second bottom bracer positioned at said bottom surface of each said ladder rung around said third rope and said fourth rope at said second end of each said ladder rung;

(f) a first top clamp above each said first top bracer at said first end of each said ladder rung holding said first and said second ropes at said first end of each said ladder rung and a first bottom clamp below each said bottom bracer at said first end of each said ladder rung holding said first and said second ropes at said first end of each said ladder rung;

(g) a second top clamp above each said top bracer at said second end of each said ladder rung holding said third and said fourth ropes at said second end of each said ladder rung and a second bottom clamp below each said bottom bracer at said second end of each said ladder rung holding said third and said fourth ropes at said second end of each said ladder rung; and (h) wherein said top rung surface and said longitudinally oriented support ribs comprise an integrally molded fiber reinforced plastic mixture including long fiber reinforcing fibers, wherein said long fiber reinforcing fibers of said plastic mixture are oriented lengthwise primarily along the length of said ladder rung surfaces.

2. The rope and ladder rung assembly as recited in claim 1 wherein said fiber reinforced plastic mixture is comprised of long glass fiber to create long glass fiber reinforcement.

3. The rope and ladder rung assembly as recited in claim 1 wherein said fiber reinforced plastic mixture includes a color additive comprising:

(a) a suitable base carrier; and (b) a non-organic color pigment.

4. The rope and ladder rung assembly as recited in claim 3 wherein said color additive makes up more than 2% of the total said fiber reinforced plastic mixture.

5. The rope and ladder rung assembly as recited in claim 4 wherein said top rung surface is an integrally molded non-skid surface.

6. A rope ladder assembly comprising:

(a) a plurality of longitudinally oriented ladder rungs, each said ladder rung comprising a longitudinally extending top rung surface, a bottom rung surface, a first end, a second end, a plurality of longitudinally extending support ribs, each said support rib having a side profile, a plurality of crossing members providing lateral support to said plurality of support ribs, said crossing members having a side profile height less than a side profile height of said plurality of support ribs, wherein said top rung surface, each said longitudinally extending support rib, and each said crossing member of each said ladder rung are integrally molded fiber reinforced plastic including long fiber reinforcing fibers, and wherein said reinforcing fibers of said fiber reinforced plastic are oriented lengthwise primarily longitudinally along said longitudinally extending top rung surface and said plurality of longitudinally extending support ribs of each said ladder rung;

(b) wherein each said ladder rung has a first pair and a second pair of longitudinally spaced apart holes extending through said top surface;

(c) a rope extending through each said hole of each said pair of longitudinally spaced apart holes, thereby creating a first pair and a second pair of adjacent said ropes;

(d) a plurality of top bracers, a said top bracer from said plurality of top bracers positioned upon each said top rung surface of each said ladder rung and around said first pair of adjacent ropes and around said second pair of adjacent ropes and a plurality of bottom bracers, a said bottom bracer from said plurality of bottom bracers positioned upon each said bottom rung surface of each said ladder rung and around said first pair of adjacent ropes and around said second pair of adjacent ropes;

(e) a plurality of top clamps, a said top clamp from said plurality of top clamps positioned upon each said top bracer of said first pair of adjacent ropes holding said ropes of said first pair of adjacent ropes and a said top clamp from said plurality of top clamps positioned upon each said top bracer of said second pair of adjacent ropes holding said ropes of said second pair of adjacent ropes; and (f) a plurality of bottom clamps, a said bottom clamp from said plurality of bottom clamps positioned upon each said bottom bracer of said first pair of adjacent ropes holding said ropes of said first pair of adjacent ropes and a said bottom clamp from said plurality of bottom clamps positioned upon each said bottom bracer of said second pair of adjacent ropes holding said ropes of said second pair of adjacent ropes.

7. The rope ladder assembly as recited in claim 6 wherein said fiber reinforced plastic is a mixture of polyurethane and wherein said reinforcing fibers are long glass fibers.

8. The rope ladder assembly as recited in claim 7 wherein each said support rib of said plurality of longitudinally extending support ribs of said ladder rungs has a side profile that varies along the length of said support rib.

9. The rope ladder assembly as recited in claim 7 wherein said fiber reinforced plastic includes a color additive having a non-organic class of pigment of a desired color.

10. The rope ladder assembly as recited in claim 9 wherein said long glass fibers extend along a length of said ladder rungs.

11. The rope ladder assembly as recited in claim 10 wherein said top rung surface of each said ladder rung has an integrally molded non-skid surface.

* * * * *